United States Patent [19]

Ogawa et al.

[11] Patent Number: 4,617,259

[45] Date of Patent: Oct. 14, 1986

[54] SILVER HALIDE COLOR PHOTOGRAPHIC MATERIAL

[75] Inventors: Tadashi Ogawa; Satoshi Nagaoka; Yuichi Ohashi, all of Kanagawa, Japan

[73] Assignee: Fuji Photo Film Co., Ltd., Kanagawa, Japan

[21] Appl. No.: 780,497

[22] Filed: Sep. 26, 1985

[30] Foreign Application Priority Data

Sep. 26, 1984 [JP] Japan ..... 59-200997

[51] Int. Cl.[4] ..... G03C 1/02; G03C 1/06; G03C 1/08; G03C 1/46

[52] U.S. Cl. ..... 430/569; 430/509; 430/571; 430/605; 430/608

[58] Field of Search ..... 430/571, 509, 569, 608, 430/605

[56] References Cited

U.S. PATENT DOCUMENTS

| | | | |
|---|---|---|---|
| 3,726,681 | 4/1973 | Pankow et al. | 430/506 |
| 3,843,369 | 10/1974 | Kumai et al. | 430/506 |
| 4,173,479 | 11/1979 | Ranz et al. | 430/507 |
| 4,477,564 | 10/1984 | Cellone et al. | 430/569 X |
| 4,520,098 | 5/1985 | Dickerson | 430/495 |
| 4,524,130 | 6/1985 | Iwasa et al. | 430/505 |
| 4,565,778 | 1/1986 | Miyamoto et al. | 430/605 X |

FOREIGN PATENT DOCUMENTS

| | | |
|---|---|---|
| 0147854 | 10/1985 | European Pat. Off. . |
| 923045 | 4/1963 | United Kingdom . |
| 1520976 | 8/1978 | United Kingdom . |
| 1570581 | 7/1980 | United Kingdom . |
| 2053499 | 2/1981 | United Kingdom . |
| 1590053 | 5/1981 | United Kingdom . |
| 1596602 | 8/1981 | United Kingdom . |
| 2083640 | 3/1982 | United Kingdom . |
| 2132373 | 7/1984 | United Kingdom . |

*Primary Examiner*—John E. Kittle
*Assistant Examiner*—Mukund J. Shah
*Attorney, Agent, or Firm*—Sughrue, Mion, Zinn, Macpeak & Seas

[57] ABSTRACT

A silver halide color photographic material comprising a support having thereon at least a layer containing a group of silver halide grains having a relation that the larger an amount of silver of a grain is, the larger an amount of a content of silver iodide therein is, at a correlative coefficient of not less than 0.7 between a silver halide crystal grain size and a silver iodide content therein. The silver halide color photographic material has improved granularity and an improved gradient, and uses a small amount of silver.

9 Claims, No Drawings

SILVER HALIDE COLOR PHOTOGRAPHIC MATERIAL

FIELD OF THE INVENTION

The present invention relates to a silver halide color photographic material, and, in particular, to a silver halide color photographic material having improved granularity and gradient with a small amount of silver used therein.

BACKGROUND OF THE INVENTION

Recently, there has been great interest in improving the image quality such as granularity and sharpness in a color photographic light-sensitive material, particularly a color photographic light-sensitive material for taking a picture.

Various methods to improve granularity of a silver halide color photographic material are known. For example, it is described in British Pat. No. 923,045 that sensitivity can be increased without lowering granularity by dividing an emulsion layer into a higher sensitive emulsion layer and a lower sensitive emulsion layer both of which emulsion layers have substantially the same color hue while reducing the maximum color density of the higher sensitive emulsion layer to a lower value. Also, the sensitivity can be increased without lowering granularity or the granularity can be improved without lowering sensitivity, according to German Pat. No. 1,958,709 disclosing a method wherein a coupler having a faster reactivity of coupling is used in the higher sensitivity emulsion layer of two emulsion layers having different sensitivity and being sensitive to the same color, and a coupler having a lower reactivity of coupling is used in the lower sensitivity emulsion layer of the two emulsion layers. Moreover, U.S. Pat. No. 3,843,369 discloses that granularity can be improved by providing a gelatin interlayer between a high sensitive emulsion layer and a low sensitive emulsion layer both of which high and low sensitive emulsion layers are sensitive to the same color, or by providing a medium sensitive silver halide emulsion layer having a low color density.

All these methods are an attempt to improve granularity at a practically important region of density by making the coupler used in a high sensitive emulsion react sufficiently to make a coarse granularity due to the high sensitive emulsion disappear, and the methods make the improvement possible.

However, because the requirement to improve the image quality is higher recently, these prior methods are insufficient in respect of the degree of improvement. Further, these methods have a fatal defect in that granularity in a shadow region or in the case of under exposure is remarkably coarse.

There are methods (described in U.S. Pat. No. 4,524,130) for preventing a color negative film from coarseness of granularity such as above, wherein the development activity is lowered by increasing the silver iodide content of a silver halide emulsion in a high sensitive emulsion layer and the granularity in a region of a low density can be improved by increasing the development inhibition by the presence of iodine (referring to T. H. James, *The Theory of The Photographic Process,* 4th Ed., page 418). But, in this case, the coupler added in the high sensitive emulsion layer does not react sufficiently and, thus, the coarse granularity in the high sensitive emulsion layer does not disappear, whereby there is a defect that coarse granularity in the high sensitive emulsion layer affects the regions of middle and high density. On the other hand, when, in order to improve granularity of the middle and high density regions, the development activity of the high sensitive emulsion layer is increased by lowering the silver iodide content thereof and granularity of the high sensitive emulsion sufficiently disappears, there is the defect that granularity in the region of low density becomes coarse.

A method of adding a so-called DIR compound in the high sensitive emulsion layer of a color negative film is also known which improves granularity in a region of low density affecting a high sensitive emulsion layer. But, as described in, for example, Japanese Patent Application (OPI) No. 97831/78 (the term "OPI" as used herein refers to a "published unexamined Japanese patent application"), it is known that this method causes a lowering of the sensitivity and reactivity of a coupler in the high sensitive emulsion layer, to thereby inhibit disappearance of granularity and make granularity of regions of middle and high density coarse.

Accordingly, sufficiently good granularity cannot be obtained from regions of low density to regions of high density by prior methods. Further, improvement of granularity by using the coupler disclosed in British Pat. No. 2,083,640 or by increasing the amount of silver used results in deterioration in sharpness.

SUMMARY OF THE INVENTION

The object of the present invention is to provide a silver halide color photographic material having good granularity over a wide density region from a low density to a high density and to provide a silver halide color photographic material having a good gradient and using only a small amount of silver.

The object of the present invention is attained by a silver halide color photographic material comprising a support having coated thereon at least one silver halide emulsion layer containing a group of silver halide grains having a relation that the larger an amount of silver of a grain is, the larger an amount of a content of silver iodide therein is, at a correlative coefficient of not less than 0.7 between a silver halide crystal grain size and a silver iodide content therein.

The above mentioned correlative coefficient is the commonly used correlative coefficient. Specifically, when the content of silver of the ith silver halide grain is represented as Mi, the number average value of N pieces of Mi is represented as $\overline{M}$, the content of silver iodide of the ith grain is represented as Ii (mol%), and the number average value of N pieces of Ii is represented as $\overline{I}$ (mol%), the correlative coefficient is represented by $$\frac{1}{N\sigma(M)\sigma(I)} \sum_{i=1}^{N} (Mi - \overline{M})(Ii - \overline{I})$$

wherein $\sigma$ (M) and $\sigma$ (I) are the standard deviations of the amount of silver in a grain and the content of silver iodide, respectively.

The effect of the present invention begins to occur at a correlative coefficient of 0.5 to 0.6, is apparent at a correlative coefficient of above 0.7, and is remarkable at a correlative coefficient above 0.8.

When a color sensitive layer is divided into two or more layers such as a so-called high sensitive emulsion layer and low sensitive emulsion layer, the silver halide grain according to the present invention may be added to any emulsion layer, to thereby be able to improve granularity and obtain a good gradient.

When the above silver halide grain according to the present invention is added to a high sensitive emulsion layer, a color image which is not coarsened is obtained in the region of a low density due to the development inhibition by large grains having a large content of silver iodide and, as development in regions of granularity disappearance in the high sensitive emulsion layer is sufficiently carried out by a small grain having a small content of silver iodide, granularity does not become coarse in the region of middle and high density, thereby resulting in an improved granularity in all density regions. In this case, the gradient in a region of low density does neither become too soft as is often found in the case of using an emulsion having a large content of silver iodide or a so-called DIR compound, nor become too contrasty as is often found in the case of using an emulsion having a small content of silver iodide and, thus, the gradient can be kept good.

When the above silver halide grain according to the present invention is added to a low sensitive emulsion layer, a color image which is not coarse is formed in the toe portion of a characteristic curve because of a large content of silver iodide of a comparatively large grain and, thus, the granularity is improved. Development in a region of high density (high exposure region) is sufficiently carried out by small grains having a small iodide content and, thus, the gradient does not become too soft in a high exposure region as is often found in a prior art emulsion having a simply increased iodide content. Moreover, the present invention does not provide a coarse granularity in not only the toe portion of the characteristic curve but also the high density portion, as is often found in a prior art emulsion having a simply decreased iodide content. As described above, in the case of applying the present invention to a low sensitive emulsion layer, an emulsion having an improved granularity and gradient is obtained.

The largest effect of the present invention is obtained by adding silver halide grains of the present invention to both a high sensitive emulsion layer and a low sensitive emulsion layer having the same color sensitivity or adding the above silver halide grains to all emulsion layers, in the case of having more than two emulsion layers. But a large effect is still obtained by adding the above silver halide grains to at least one emulsion layer.

Various methods for measuring the grain size of a silver halide grain (the amount of silver in each grain) are known. When the grain size (the amount of silver) and the content of silver iodide in each grain are simultaneously measured as in the case of the present invention, it is useful to use an electron probe microanalyzer as described in Japanese Patent Application No. 248469/83 (which corresponds to European Patent Application No. 147,854A and U.S. patent application Ser. No. 687,347, filed on Dec. 28, 1984). In this method, the iodine content and the amount of silver are simultaneously measured by irradiating a narrowed electron beam to each silver halide grain and measuring the strength of characteristic X-rays of Ag and I from each grain.

It is preferred for the purpose of measurement that the distribution of iodine inside a grain is uniform. As this is possible by processing a sample before measurement, the iodine distribution of a silver halide grain according to the present invention does not itself need to be uniform therein. In order to obtain a correlative coefficient accurately, more than 50 grains need to be measured. In the case of an emulsion having a broad distribution of grain size, a correlative coefficient between grain size and AgI content is approximately obtained by a classification using centrifugation and by measuring by use of X-ray diffraction.

The silver halide grain according to the present invention may have a regular crystal form such as a cubic form, an octahedral form, a dodecahedral form, a tetradecahedral form, an irregular form such as a spherical form, a tabular form, or a composite of these crystal forms. The grain may have different phases such as a layer structure and an epitaxial structure inside the grain, a homogeneous phase throughout the grain or a mixture of these phases.

A mixture of silver halide crystals having any different forms and structures may be used from the viewpoint of granularity. From the viewpoint of a gradient, however, it is preferred to use silver halide crystals being not so much different in form and structure between large size grain and small size grain. When the form and structure are different, it is preferred that the form and structure continuously change in proportion to the size.

It is not desirable that the distribution of grain size of an emulsion according to the present invention be too narrow because the correlative coefficient is small. On the other hand, it is also not desirable that the distribution be too broad because the sensitivity/granularity ratio lowers due to a sensitivity lowering of a large size grain, the optical scattering makes sharpness lower in certain cases, or the small size grain accelerates the development of a large size grain to lower granularity. Accordingly, it is preferred that the grain size of the emulsion according to the present invention has an adequate broad distribution. A preferable ratio of standard deviation to mean grain size is from 0.1 to 0.5, more preferably from 0.10 to 0.4. In this case, the value obtained by averaging, numerically, the diameter of a globe having the same volume as the grain is used as a mean grain size.

A protective layer, an interlayer and an emulsion layer used in the color photographic light-sensitive material of the present invention may contain a fine grain of a silver halide crystal which is substantially insensitive to light usually used for photographing.

When the above mentioned substantially light-insensitive fine silver halide grain is added to the emulsion layer having light-sensitive silver halide grains according to the present invention, as far as said fine silver halide grain does not have a substantial sensitivity and does not form an image by itself, any fine silver halide grain having either no fog nucleus, fogged on the surface thereof, or fogged inside it may be used, and such fine silver halide grain is the silver halide grain having no relation to the component of the present invention.

The light-sensitive silver halide grain according to the present invention comprises, preferably silver iodobromide and may contain silver chloride. The effect of the invention arises when the silver iodide content is 4 mol% or more at a volume mean value of the grain, and is remarkable when the silver iodide content is 6 mol% or more.

The silver halide emulsion used in the present invention can be prepared by any methods known in the art of silver halide color photographic materials or combinations thereof. That is, a reaction of a soluble silver salt and a soluble halide can be carried out to form silver halide crystal grains by an acid method, a neutralization method, a semi-ammonia method, or an ammonia method in combination with a single jet method, a double jet method, a controlled double jet method, or a triple jet method. Moreover, the above combinations can be used as two or more steps.

The silver halide emulsion according to the present invention may be a mixture of two or more emulsions prepared by the methods described above. In order to obtain good properties both in granularity and gradient, it is preferred that grain form and grain structure hardly change with a change of the grain size after mixing them, or that, if the grain form and structure change, they change continuously with the change of grain size, to obtain a more preferable effect.

Firstly, an example of preparation by mixing two or more emulsions is shown.

PREPARATION EXAMPLE 1

24 g of gelatin, 16 g of potassium bromide and 15 g of potassium iodide were added to 1,000 ml of water, and the mixture was stirred and dissolved at 70° C. To the mixture 1,000 ml of an aqueous solution having dissolved therein 150 g of silver nitrate and 750 ml of an aqueous solution having dissolved therein 110 g of potassium bromide were added over 45 minutes. (Emulsion 1).

24 g of gelatin, 19 g of potassium bromide and 10.5 g of potassium iodide were added to 1,000 ml of water and the mixture was stirred and dissolved at 65° C. To the mixture 1,000 ml of an aqueous solution having dissolved therein 150 g of silver nitrate and 750 ml of an aqueous solution having dissolved therein 110 g of potassium bromide were added over 30 minutes (Emulsion 2).

24 g of gelatin, 22.5 g of potassium bromide and 6 g of potassium iodide were added to 1,000 ml of water and the mixture was stirred at 60° C. to dissolve the potassium bromide and potassium iodide. To the mixture 1,000 ml of an aqueous solution having dissolved therein 150 g of silver nitrate and 750 ml of an aqueous solution having dissolved therein 110 g of potassium bromide were added over 20 minutes (Emulsion 3).

After the above three emulsions were washed with water to remove excess salt therefrom and mixed so that the ratio of Emulsion 1, Emulsion 2 and Emulsion 3 is 1:0.7:0.5, based on the amount of silver, the correlative coefficient of the amount of silver in grain and AgI content was measured according to the electron microprobe analyzer method. The correlative coefficient was 0.74.

PREPARATION EXAMPLE 2

The emulsion of the present invention can be prepared using a monodispersed emulsion.

1,000 ml of an ammoniac silver nitrate aqueous solution having dissolved therein 150 g of silver nitrate, 750 ml of an aqueous solution having dissolved therein 110 g of potassium bromide, and 250 ml of an aqueous solution having dissolved therein 14.7 g of potassium iodide were added to an aqueous gelatin solution held constant at 75° C. while keeping the pAg constant over 20 minutes, so that the final silver iodide content was 10 mol% (Emulsion 4).

1,000 ml of an ammoniac silver nitrate aqueous solution having dissolved therein 150 g of silver nitrate, 750 ml of an aqueous solution having dissolved therein 110 g of potassium bromide, and 250 ml of an aqueous solution having dissolved therein 10.3 g of potassium iodide were added to an aqueous gelatin solution held constant at 65° C. while keeping the pAg constant over 14 minutes, so that the final silver iodide content was 7 mol% (Emulsion 5).

1,000 ml of an ammoniac silver nitrate aqueous solution having dissolved therein 150 g of silver nitrate, 750 ml of an aqueous solution having dissolved therein 110 g of potassium bromide, and 250 ml of an aqueous solution having dissolved therein 5.9 g of potassium iodide were added to an aqueous gelatin solution held constant at 55° C. while keeping the pAg constant over 10 minutes, so that the final silver iodide content is 4 mol% (Emulsion 6).

After the above three emulsions were washed with water to remove excess salt therefrom, the emulsions were mixed so that the ratio of Emulsion 4, Emulsion 5 and Emulsion 6 was 1:0.76:0.58, based on the amount of silver, and, then, the correlative coefficient was measured according to the same method as above and was 0.82.

PREPARATION EXAMPLE 3

The emulsion of the present invention can be prepared without mixing emulsions.

24 g of gelatin, 16 g of potassium bromide and 12 g of potassium iodide were added to 1,000 ml of water and the mixture was stirred and dissolved at 70° C. To the mixture 500 ml of an aqueous solution having dissolved therein 50 g of silver nitrate and 250 ml of an aqueous solution having dissolved therein 18 g of potassium bromide were added over 18 minutes. After stirring for 5 minutes, 1,000 ml of an aqueous solution having dissolved therein 100 g of silver nitrate and 500 ml of an aqueous solution having dissolved therein 84 g of potassium bromide were added to the mixture over 6 minutes, thereafter the mixture was washed with water to remove excess salt (Emulsion 7).

The correlative coefficient was measured according to the same method as above and was 0.79. Although the correlative coefficient of the emulsion is comparatively high, a small size grain whose AgI content was close to zero was found and an AgI content discontinuously changed with a change of the amount of silver. This is believed to be due to that the addition of a silver ion and a halogen ion in the second step is accompanied with a new grain formation.

PREPARATION EXAMPLE 4

24 g of gelatin, 16 g of potassium bromide and 12 g of potassium iodide were added to 1,000 ml of water and the mixture was stirred and dissolved at 67° C. To the mixture 500 ml of an aqueous solution having dissolved therein 50 g of silver nitrate and 250 ml of an aqueous solution having dissolved therein 18 g of potassium bromide were added over 16 minutes. After stirring for 10 minutes, 1,000 ml of an aqueous solution having dissolved therein 100 g of silver nitrate and 500 ml of an aqueous solution having dissolved therein 84 g of potassium bromide were added to the mixture over 6 minutes, thereafter the mixture was stirred over 20 minutes and washed with water to remove excess salt. The correlative coefficient was measured according to the same method as above and was 0.77 (Emulsion 8).

In spite of the fact that the distribution of the amount of silver in the grain and the AgI content of this emulsion were narrower than that of Emulsion 7, the relationship approximately continuously changed.

PREPARATION EXAMPLE 5

The emulsion of the present invention can be prepared according to a method using a silver halide solvent such as ammonia and so on.

24 g of gelatin, 27.5 g of potassium bromide and 12 g of potassium iodide were added to 1,000 ml of water and the mixture was stirred and dissolved at 75° C. To the mixture 500 ml of an ammoniac silver nitrate aqueous solution containing 50 g of silver nitrate was added over 5 minutes. After stirring for 10 minutes, 1,000 ml of an aqueous solution having dissolved therein 100 g of silver nitrate and 500 ml of an aqueous solution having dissolved therein 86 g of potassium bromide were added to the mixture over 7 minutes. This emulsion was washed with water to remove excess salt and the correlative coefficient was measured according to the same method as above and was 0.73.

During the formation of the above silver halide grain emulsion, rhodan salts, thioether compounds, amine compounds and thiourea compounds may be present. Particularly, thioether compounds are useful to control the distribution of the grain size.

During the formation of silver halide grains or physical ripening of silver halide emulsions, a cadmium salt, a zinc salt, a lead salt, a thallium salt, an iridium salt or a complex salt thereof, a rhodium salt or a complex salt thereof, an iron salt or a complex salt thereof, etc., may be present in the system.

Silver halide emulsions are usually chemically sensitized. For the chemical sensitization, methods as described, for example, in H. Frieser, editor, *Die Grundlagen der Photographischen Prozesse mit Silberhalogeniden* (published by Akademische Verlagsgesellschaft, 1968), pages 675–735, can be used.

Particularly, such methods include a sulfur sensitization method using an active gelatin or a compound containing sulfur capable of reacting with silver (e.g., a thiosulfate, a thiourea, a mercapto compound, a rhodanine, etc.); a reduction sensitizing method using a reducing material (e.g., a stannous salt, an amine, a hydrazine derivative, formamidinesulfinic acid, a silane compound, etc.); and a noble metal sensitization method using a noble metal compound (e.g., a gold complex salt and complex salts of metals belonging to group VIII of the Periodic Table, such as Pt, Ir, Pd, etc.), and these methods may be used singly or as a combination thereof.

Photographic emulsions are used in the present invention may include various compounds for the purpose of preventing fog formation or of stabilizing photographic performance in light-sensitive material during the production, storage or photographic processing thereof. For example, antifoggants or stabilizers can be incorporated, including azoles (for example, benzothiazolium salts, nitroimidazoles, nitrobenzimidazoles, chlorobenzimidazoles, bromobenzimidazoles, nitrobenzotriazoles, benzotriazoles, aminotriazoles and so on); mercapto compounds (for example, mercaptothiazoles, mercaptobenzothiazoles, mercaptobenzimidazoles, mercaptothiadiazoles, mercaptotetrazoles (particularly 1-phenyl-5-mercaptotetrazoles), mercaptopyrimidines, mercaptotriazines and so on); thioketo compounds, such as oxazolinethione, etc.; azaindenes (for example, triazaindenes, tetraazaindenes (particularly 4-hydroxysubstituted (1,3,3a,7)tetraazaindenes), pentaazaindenes, and so on); benzenethiosulfonic acids; benzenesulfinic acids; benzenesulfonic amides and so on.

Photographic emulsion layers or other hydrophilic colloid layers of the light-sensitive material of the present invention may contain various surface active agents as coating aids or for other various purposes, e.g., prevention of charging, improvement of slipping properties, acceleration of emulsification and dispersion, prevention of adhesion, and improvement of photographic characteristics (particularly development acceleration, high contrast, and sensitization).

The photographic light-sensitive material of this invention may further contain in the silver halide emulsion layers polyalkylene oxide or the ether, ester or amine derivative thereof, a thioether compound, a thiomorpholine, a quaternary ammonium salt compound, a urethane derivative, a urea derivative, an imidazole derivative, a 3-pyrazolidone, etc., for the purpose of increasing the sensitivity, contrast, and development acceleration.

The photographic light-sensitive material used in this invention may further contain a water-insoluble or water sparingly soluble synthetic polymer dispersion for improving the dimensional stability of the silver halide photographic emulsion layers and other hydrophilic colloid layers. Examples of the hydrophobic polymers are polymers or copolymers of alkyl acrylate or methacrylate (hereinafter, (meth)acrylate), alkoxyalkyl (meth)acrylate, glycidyl (meth)acrylate, (meth)acrylamide, a vinyl ester (e.g., vinyl acetate), acrylonitrile, an olefin, styrene, etc., singly or as a combination thereof, or a combination of the foregoing monomers and acrylic acid, methacrylic acid, $\alpha,\beta$-unsaturated dicarboxylic acid, hydroxyalkyl (meth)acrylate, sulfoalkyl (meth)acrylate, styrenesulfonic acid, etc.

The photographic emulsion used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful. Any conventionally utilized nucleus for cyanine dyes, such as basic heterocyclic nuclei, is applicable to these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

To merocyanine dyes and complex merocyanine dyes, as nuclei having a ketomethylene structure, 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be applicable.

These sensitizing dyes can be employed individually, and can also be employed in combination thereof. A combination of sensitizing dyes is often used, particularly for the purpose of supersensitization.

The sensitizing dyes may be present in the emulsion together with dyes which themselves do not give spectrally sensitizing effects but exhibit a super-sensitizing effect or materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Pat. No. 3,743,510), cadmium salts, azaindene compounds, etc., can be present. The combinations described in U.S. Pat. Nos. 3,615,613, 3,615,641, 3,617,295 and 3,635,721 are particularly useful.

The silver halide color photographic material usually has at least one red-sensitive emulsion layer, at least one green-sensitive emulsion layer and at least one blue-sensitive emulsion layer on a support. The positioning order of these emulsion layers may be optionally selected according to the particular purpose. Usually, the red-sensitive emulsion layer contains a cyan forming coupler, the green-sensitive emulsion layer contains a magenta forming coupler and the blue-sensitive emulsion layer contains a yellow forming coupler, but other combinations may be employed according to the particular purpose.

The photographic materials of this invention may further contain color forming couplers, that is, compounds each capable of coloring by oxidative coupling with the oxidation product of the primary aromatic amino developing agent (e.g., a phenylenediamine derivative or an aminophenol derivative) in a color development process. Examples of the magenta couplers that can be used in the present invention include 5-pyrazolone couplers, pyrazolobenzimidazole couplers, pyrazolotriazole couplers, pyrazoloimidazole couplers, pyrazolopyrazole couplers, pyrazolotetrazole couplers, cyanoacetylcumarone couplers, open chain acylacetonitrile couplers, etc. Examples of the yellow couplers include acylacetamide couplers (e.g., benzoylacetanilide couplers, pivaloylacetanilide couplers, etc.). Also, examples of the cyan couplers are naphthol couplers, phenol couplers, etc.

As such couplers, nondiffusible couplers having a hydrophobic group called a "ballast group" in the molecule, or polymerized couplers are preferred. The couplers may be of 4-equivalent or 2-equivalent to silver ion. Also, colored couplers having a color correction effect or so-called DIR couplers capable of releasing a development inhibitor with the progress of development may be used. Also, non-coloring DIR coupling compounds which form colorless products by the coupling reaction and release development inhibitors may be used.

The above couplers may be used in combination thereof in the same layer, or one coupler may be added to two or more layers.

For incorporating couplers into silver halide emulsion layers, known methods, such as the method described, for example, in U.S. Pat. No. 2,322,027 can be used. For example, the coupler is dissolved in a high boiling organic solvent such as a phthalic acid alkyl ester (e.g., dibutyl phthalate, dioctyl phthalate, etc.), a phosphoric acid ester (e.g., diphenyl phosphate, triphenyl phosphate, tricresyl phosphate, dioctylbutyl phosphate, etc.), a citric acid ester (e.g., tributyl acetylcitrate, etc.), a benzoic acid ester (e.g., octyl benzoate, etc.), an alkyl amide (e.g., diethyllaurylamide, etc.), a fatty acid ester (e.g., dibutoxyethyl succinate, dioctyl azelate, etc.), a trimesic acid ester (e.g., tributyl trimesate, etc.), or a low boiling organic solvent having a boiling point of from about 30° C. to 150° C. such as a lower alkyl acetate (e.g., ethyl acetate, butyl acetate, etc.), ethyl propionate, secondary butyl alcohol, methyl isobutyl ketone, β-ethoxyethyl acetate, methyl cellosolve acetate, etc., and then the solution of the coupler is dispersed in an aqueous solution of a hydrophilic colloid. A mixture of the foregoing high boiling organic solvent and the low boiling organic solvent can also be used. Also, the dispersing method by the polymer as described in Japanese Patent Publication No. 39853/76 and Japanese Patent Application (OPI) No. 59943/76 can be used.

When the coupler has an acid group such as a carboxylic acid group and a sulfonic acid group, the coupler is introduced into an aqueous solution of a hydrophilic colloid as an alkaline aqueous solution.

As a binder for silver halide photographic emulsions or as the protective colloid, gelatin is advantageously used but hydrophilic colloids other than gelatin may also be used alone or in combination with gelatin.

In the present invention gelatin may be limetreated gelatin or acid-treated gelatin. A method of preparing gelatin is, in detail, described in Arthur Veis, *The Macromolecular Chemistry of Gelatin* (Academic Press, 1964).

The photographic materials of this invention may further contain inorganic or organic hardening agents in the silver halide photographic emulsion layers or other hydrophilic colloid layers. Examples of such hardening agents include chromium salts (e.g., chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloylhexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.), etc. They may be used singly or as a combination thereof.

When dyes or ultraviolet absorbents are incorporated in the hydrophilic colloid layers of the photographic materials of this invention, these additives may be mordanted by cationic polymers.

The photographic materials of this invention may further contain hydroquinone derivatives, aminophenol derivatives, gallic acid derivatives, ascorbic acid derivatives, etc., as color fogging preventing agents.

The photographic materials of this invention may further contain ultraviolet absorbents in the hydrophilic colloid layers. Examples of the ultraviolet absorbents are aryl-substituted benzotriazole compounds (e.g., described in U.S. Pat. No. 3,533,794), 4-thiazolidone compounds (e.g., described in U.S. Pat. Nos. 3,314,794, 3,352,681), benzophenone compounds (e.g., described in Japanese Patent Application (OPI) No. 2784/71), cinnamic acid ester compounds (e.g., described in U.S. Pat. Nos. 3,705,805, 3,707,375), butadiene compounds (e.g., described in U.S. Pat. No. 4,045,229), or benzoxazole compounds (e.g., described in U.S. Pat. No. 3,700,455). Couplers having an ultraviolet absorbing property (e.g., α-naphtol cyan dye forming couplers) and polymers having an ultraviolet absorbing property may be used. These ultraviolet absorbents may be fixed in the specific layer.

The photographic materials of this invention may further contain water-soluble dyes in the hydrophilic colloid layers as filter dyes or for various purposes such as irradiation prevention, etc. Examples of such dyes are oxonol dyes, hemioxonol dyes, styryl dyes, merocyanine dyes, cyanine dyes, and azo dyes. Among these dyes, oxonol dyes, hemioxonol dyes, and merocyanine dyes are particularly useful.

At the practice of this invention, various fading preventing agents may be used. Examples of the fading preventing agents include hydroquinone derivatives, gallic acid derivatives, p-alkoxyphenols, p-oxyphenol derivatives, bisphenols, etc. They can be used singly or as a mixture thereof.

For the photographic processing of the photographic emulsion layers of this invention, known processes and the known processing compositions, as described, for example, in *Research Disclosure,* No. 176, pages 28–30 can be applied. The processing temperature is usually selected in the range of from 18° C. to 50° C., but the temperature may be lower than 18° C. or higher than 50° C., if desired.

The color developer is generally an alkaline aqueous solution containing a color developing agent. The color developing agent for use in this invention includes known primary aromatic amine developers, for example, a phenylenediamine (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, etc.).

Besides, developers described in L. F. A. Mason, *Photographic Processing Chemistry* (Focal Press, 1966), pp. 226–229, U.S. Pat. Nos. 2,193,015 and 2,592,364, and Japanese Patent Application (OPI) No. 64933/73 may be used.

The color developing solution may contain a pH buffer agent such as sulfite, carbonate, borate and phosphate of an alkaline metal, a development restrainer such as a bromide compound, an iodide compound and an organic antifoggant. Moreover, if desired, it may contain a water softener, a preservative such as hydroxylamine, an organic solvent such as benzyl alcohol, diethylene glycol, a development accelerator such as polyethylene glycol, a quaternary ammonium salt, amines, a dye forming coupler, a competing coupler, a fogging agent such as sodium boron hydride, an auxiliary developer such as 1-phenyl-3-pyrazolidone, a viscosity imparting agent, a polycarboxylate chelate agent and an antioxidant.

After color development, the photographic emulsion layers are usually subjected to bleach processing. The bleach process may be performed simultaneously with a fix process or may be performed separately. The bleaching agent includes a compound of a polyvalent metal such as iron (III), cobalt (III), chromium (IV), copper (II), etc., peroxides, quinones, nitroso compounds, etc. For example, ferricyanides; dichromates; organic complex salts of iron (III) or cobalt (III), e.g., complex salts of aminopolycarboxylic acids such as ethylenediaminetetraacetic acid, nitrilotriacetic acid, 1,3-diamino-2-propanoltetraacetic acid, etc.; complex salts of organic acids such as citric acid, tartaric acid, malic acid, etc.; persulfates, permanganates; nitrosophenol, etc. Among these compounds, potassium ferricyanide, ethylenediaminetetraacetic acid iron (III) sodium salt, and ethylenediaminetetraacetic acid iron (III) ammonium salt are particularly advantageous. The ethylenediaminetetraacetic acid iron (III) complex salts are useful in either an independent bleach solution or in a blix solution.

As a fix solution, a fix composition generally used can be employed. Examples of the fixing agent for use in the fix solution include a thiosulfate, a thiocyanate, as well as organic sulfur compounds having an effect as a fixing agent. The fix solution may further contain a water-soluble aluminum salt as a hardening agent.

The present invention will now be explained by reference to specific examples which are not meant to be limiting. Unless otherwise specified, all ratios, percents, etc., are by weight.

EXAMPLE 1

24 g of gelatin, 16 g of potassium bromide and 9 g of potassium iodide were added to 1,000 ml of water, and the mixture was stirred and dissolved at 75° C. To the mixture 250 ml of an aqueous solution having dissolved therein 50 g of silver nitrate and 500 ml of an aqueous solution having dissolved therein 26 g of potassium bromide were added over 10 minutes. Moreover, 750 ml of an aqueous solution having dissolved therein 100 g of silver nitrate and 500 ml of an aqueous solution having dissolved therein 84 g of potassium bromide were added to the mixture over 30 minutes. This emulsion was washed with water to remove excess salt. Chloroauric acid, sodium thiosulfonate and potassium thiocyanate were added to the resulting emulsion, and thereby the emulsion was chemically sensitized so that the relation between sensitivity and fog was optimal. Then, gelatin was added to the emulsion to obtain Emulsion A.

24 g of gelatin, 16 g of potassium bromide and 9 g of potassium iodide were added to 1,000 ml of water, and the mixture was stirred and dissolved at 75° C. To the mixture 250 ml of an aqueous solution having dissolved therein 50 g of silver nitrate and 500 ml of an aqueous solution having dissolved therein 20 g of potassium bromide were added over 14 minutes. Moreover, 750 ml of an aqueous solution having dissolved therein 100 g of silver nitrate and 500 ml of an aqueous solution having dissolved therein 84 g of potassium bromide were added to the mixture over 10 minutes. This emulsion was washed with water to remove excess salt. Then, chloroauric acid, sodium thiosulfonate and potassium thiocyanate were added to the emulsion, and thereby the emulsion was chemically sensitized so that the relation between sensitivity and fog was optimal. Then, gelatin was added to the resulting solution to obtain Emulsion B.

24 g of gelatin, 17 g of potassium bromide and 7.5 g of potassium iodide were added to 1,000 ml of water, and the mixture was stirred and dissolved at 75° C. To the mixture 250 ml of an aqueous solution having dissolved therein 50 g of silver nitrate and 500 ml of an aqueous solution having dissolved therein 26 g of potassium bromide were added over 10 minutes. Moreover, 750 ml of an aqueous solution having dissolved therein 100 g of silver nitrate and 500 ml of an aqueous solution having dissolved therein 84 g of potassium bromide were added to the mixture over 30 minutes. This emulsion was washed with water to remove excess salt. Then, chloroauric acid, sodium thiosulfonate and potassium thiocyanate were added to the emulsion, and thereby the emulsion was chemically sensitized so that the relation between sensitivity and fog was optimal. Then, gelatin was added to the resulting emulsion to obtain Emulsion C.

24 g of gelatin, 15 g of potassium bromide and 10.5 g of potassium iodide were added to 1,000 ml of water, and the mixture was stirred and dissolved at 75° C. To the mixture 250 ml of an aqueous solution having dissolved therein 50 g of silver nitrate and 500 ml of an aqueous solution having dissolved therein 26 g of potassium bromide were added over 10 minutes. Moreover, 750 ml of an aqueous solution having dissolved therein 100 g of silver nitrate and 500 ml of an aqueous solution having dissolved therein 84 g of potassium bromide were added to the mixture over 30 minutes. This emulsion was washed with water to remove excess salt. Then, chloroauric acid, sodium thiosulfonate and potassium thiocyanate were added to the emulsion, and thereby the emulsion was chemically sensitized so that the relation between sensitivity and fog was optimal. Then, gelatin was added to the resulting emulsion to obtain Emulsion D.

The mean grain size and the correlative coefficient of these emulsions are shown below.

| Emulsion | Mean Grain Size (μm) | Correlative Coefficient | AgI Content (%) |
|---|---|---|---|
| A | 0.67 | 0.53 | 6 |
| B | 0.70 | 0.76 | 6 |
| C | 0.76 | 0.41 | 5 |
| D | 0.61 | 0.56 | 7 |

A mixture of 5 g of Coupler M-1, 5 g of tricresyl phosphate and 10 ml of ethyl acetate was heated and dissolved and, then, mixed with an aqueous solution containing gelatin and sodium dodecylbenzenesulfonate. Then, this mixture was mechanically stirred at high speed to obtain an emulsion dispersion. 4-Hydroxy-6-methyl-1,3,3a,7-tetraazaindene was added to Emulsion A, Emulsion B, Emulsion C and Emulsion D, respectively, thereafter the above prepared emulsion dispersion and a hardener were added to each of the mixture.

Each of these mixtures was coated on a triacetyl cellulose base together with a protective layer so that the amount of coated silver halide was 0.88 g/m$^2$, based on the amount of silver, and the amount of coated Coupler M-1 was 0.097 g/m$^2$. These samples were called Sample a, Sample b, Sample c and Sample d, respectively.

These four samples were exposed through an optical wedge and processed as described below. The sensitivity of the processed sample was measured and the granularity was measured according to the conventional RMS method. The values measured at two points having a magenta density of (fog+0.15) and a magenta density of (fog+0.5) using a cyclic aperture having a diameter of 48 μm were used as an RMS value.

In this case the relative sensitivity is the value obtained by converting the reciprocal value of the amount of exposure providing a density of (fog+0.15) to a relative value when that of Sample a is 100.

These results are shown in Table 1.

The developing process used is described below.

| | |
|---|---|
| 1. Color Development | 3 min 15 sec (38° C.) |
| 2. Bleach | 6 min 30 sec |
| 3. Washing | 2 min 10 sec |
| 4. Fix | 4 min 20 sec |
| 5. Washing | 3 min 15 sec |
| 6. Stabilization | 1 min 05 sec |

The compound of the processing solution used in each process is described below.

| | |
|---|---|
| Color Developing Solution: | |
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N—ethyl-N—β-hydroxyethylamino)-2-methylaniline Sulfate | 4.5 g |
| Water to make | 1 liter |
| Bleaching Solution: | |
| Ammonium Bromide | 160.0 g |
| Aqueous Ammonia (28%) | 25.0 ml |
| Sodium Ethylenediaminetriacetate | 130 g |
| Glacial Acetic Acid | 14 ml |
| Water to make | 1 liter |
| Fixing Solution: | |
| Sodium Tetrapolyphosphate | 2.0 g |
| Sodium Sulfite | 4.0 g |
| Ammonium Thiosulfite (70%) | 175.0 ml |
| Sodium Bisulfite | 4.6 g |
| Water to make | 1 liter |
| Stabilizing Solution: | |
| Formalin | 8.0 ml |
| Water to make | 1 liter |

TABLE 1

| Sample | Relative Sensitivity | RMS (fog + 0.15) | RMS (fog + 0.5) |
|---|---|---|---|
| a (Comparative Example) | 100 | 0.017 | 0.012 |
| b (The Present Invention) | 100 | 0.014 | 0.010 |
| c (Comparative Example) | 104 | 0.019 | 0.010 |
| d (Comparative Example) | 96 | 0.015 | 0.014 |

Each RMS value of Sample a is inferior to that of Sample b of the present invention. Granularity of Sample c is good in the region of granularity disappearance at fog+0.5, but it is inferior in the toe region. Granularity of Sample d is relatively good in the toe region, but it is inferior in the region of granularity disappearance. It is shown that granularity of Sample b of the present invention is good in the region of a low density and a high density.

EXAMPLE 2

A mixture of 5 g of Coupler C-1, 0.5 g of Coupler C-2, 3 g of tricresyl phosphate and 8 ml of ethyl acetate was heated, dissolved and added to an aqueous solution containing gelatin and sodium di(2-ethylhexyl)-α-sulfosuccinate, thereafter was mechanically stirred at high speed to obtain an emulsion dispersion. 4-Hydroxy-6-methyl-1,3,3a,7-tetraazaindene was added to Emulsion A, Emulsion B, Emulsion C and Emulsion D, respectively, used in Example 1. Thereafter, the above emulsion dispersion and a hardener were added to each of the mixtures. Each of these mixtures was coated on a triacetyl cellulose support together with a protective layer so that the amount of coated silver halide was 1.54 g/m² based on the amount of silver and the amount of coated Coupler C-1 was 0.48 g/m². These samples were called Sample e, Sample f, Sample g and Sample h, respectively.

These four samples were exposed through an optical wedge and processed in the same way as in Example 1. The results are shown in Table 2.

TABLE 2

| Sample | Relative Sensitivity | Gamma Ratio | RMS (fog + 0.2) |
|---|---|---|---|
| e (Comparative Example) | 100 | 0.87 | 0.014 |
| f (Present Invention) | 102 | 1.04 | 0.010 |
| g (Comparative Example) | 106 | 0.87 | 0.016 |
| h (Comparative Example) | 98 | 0.78 | 0.010 |

The gamma ratio is defined by $\overline{QR}/\overline{PQ}$ wherein on the characteristic curve, P is a cyan density of 0.2 above fog, Q is a cyan density obtained by an exposure amount providing a log E value 0.5 greater than the log E value necessary to obtain the density P, and R is a cyan density obtained by an exposure amount providing a log E value 0.5 greater than the log E value necessary to obtain the density Q.

Sample e and Sample g are inferior to Sample f of the present invention, as Sample e and Sample g have a remarkably soft gradient in the region of high density and a large RMS value. Sample h has a good granularity as having a small RMS value, but it is inferior in linearity of gradient. Sample f of the present invention is most preferable in granularity and gradient. In the case that a gradient of the high density region is unnecessary, a light-sensitive material having a good gradient can be prepared using a small silver amount.

EXAMPLE 3

The layers shown below were coated on a triacetyl cellulose support to prepare a multilayer color light-sensitive material.

1st Layer: Gelatin layer containing black colloidal silver

| | |
|---|---|
| Colloidal silver | 0.2 g/m² |
| Gelatin | 1.8 g/m² |

2nd Layer: Interlayer comprising gelatin

| | |
|---|---|
| Gelatin | 1.5 g/m² |

3rd Layer: First red-sensitive emulsion layer comprising a mixture of a silver iodobromide emulsion having a mean grain size of 0.5 μm and 5 mol% of silver iodide, adsorbed by Sensitizing Dyes I, II and III and containing 4-hydroxy-6-methyl-1,3,3a,7-tetraazaindene, and an emulsion dispersion containing Couplers C-2, C-3 and C-4.

| | |
|---|---|
| Ag | 1.54 g/m² |
| Gelatin | 2.1 g/m² |
| Coupler C-2 | 0.0042 mol/1 mol of Ag |
| Coupler C-3 | 0.042 mol/1 mol of Ag |
| Coupler C-4 | 0.032 mol/1 mol of Ag |

4th Layer: Second red-sensitive emulsion layer comprising a mixture of a silver iodobromide emulsion having a mean grain size of 0.8 μm and 8.5 mol% of silver iodide, adsorbed by Sensitizing Dyes I, II and III and containing 4-hydroxy-6-methyl-1,3,3a,7-tetraazaindene and an emulsion dispersion containing Couplers C-3 and C-5.

| | |
|---|---|
| Ag | 0.84 g/m² |
| Gelatin | 0.98 g/m² |
| Coupler C-3 | 0.024 mol/1 mol of Ag |
| Coupler C-5 | 0.008 mol/1 mol of Ag |

5th Layer: Interlayer comprising gelatin and an emulsion dispersion containing 2,5-di-t-octylhydroquinone.

| | |
|---|---|
| 2,5-di-t-octylhydroquinone | 0.05 g/m² |
| Gelatin | 1.1 g/m² |

6th Layer: First green-sensitive emulsion layer comprising a mixture of a silver iodobromide emulsion having a mean grain size of 0.45 μm and 6 mol% of silver iodide, adsorbed by Sensitizing Dyes IV and V and containing 4-hydroxy-6-methyl-1,3,3a,7-tetraazaindene, and an emulsion dispersion containing Couplers M-1, M-2 and Y-3.

| | |
|---|---|
| Ag | 1.2 g/m² |
| Gelatin | 1.8 g/m² |
| Coupler M-1 | 0.067 mol/1 mole of Ag |
| Coupler M-2 | 0.018 mol/1 mol of Ag |
| Coupler Y-3 | 0.0077 mol/1 mol of Ag |

7th Layer: Second green-sensitive emulsion layer comprising a mixture of a silver iodobromide emulsion having a mean grain size of 0.75 μm and 8.5 mol% of silver iodide, adsorbed by Sensitizing Dyes IV and V and containing 4-hydroxy-6-methyl-1,3,3a,7-tetraazaindene, and an emulsion dispersion containing Couplers M-1, M-2 and M-3.

| | |
|---|---|
| Ag | 1.1 g/m² |
| Gelatin | 1.2 g/m² |
| Coupler M-1 | 0.0068 mol/1 mol of Ag |
| Coupler M-2 | 0.0033 mol/1 mol of Ag |
| Coupler M-3 | 0.0068 mol/1 mol of Ag |

8th Layer: Interlayer containing yellow colloidal silver and an emulsion dispersion of 2,5-di-t-octylhydroquinone.

| | |
|---|---|
| Colloidal silver | 0.12 g/m² |
| 2,5-di-t-octylhydroquinone | 0.10 g/m² |
| Gelatin | 1.5 g/m² |

9th Layer: First blue-sensitive emulsion layer comprising a mixture of Silver Iodobromide Emulsion E having a mean grain size of 0.54 μm and 6.7 mol% of silver iodide and containing 4-hydroxy-6-methyl-1,3,3a,7-tetraazaindene, and an emulsion dispersion containing Couplers Y-1 and Y-2.

| | |
|---|---|
| Ag | 0.72 g/m² |
| Gelatin | 1.6 g/m² |
| Couplwer Y-1 | 0.22 mol/1 mol of Ag |
| Coupler Y-2 | 0.024 mol/1 mol of Ag |

10th Layer: Second blue-sensitive emulsion layer comprising a mixture of Silver Iodobromide Emulsion G having a mean grain size of 0.95 μm and 9.2 mol% of silver iodide, adsorbed by Sensitizing Dye VI and containing 4-hydroxy-6-methyl-1,1,3a,7-tetraazaindene, and an emulsion dispersion containing Coupler Y-1.

| | |
|---|---|
| Ag | 0.81 g/m² |
| Gelatin | 0.92 g/m² |
| Coupler Y-1 | 0.023 mol/1 mol of Ag |

11th Layer: Gelatin protective layer containing polymethyl methacrylate grains having a mean grain size of 1.8 μm.

Gelatin 1.5 g/m²

A gelatin hardener and a coating aid agent were added to each of the above 1st layer through 11th layer, thereafter coated. The thus prepared sample was called Sample i.

Sample j was prepared in the same manner as Sample i except for replacing Emulsion E in the 9th layer of Sample i with Emulsion F.

Sample k was prepared in the same manner as Sample i except for replacing Emulsion G in the 10th layer of Sample i with Emulsion H.

Sample l was prepared in the same manner as Sample j except for replacing Emulsion G in the 10th layer of Sample j with Emulsion H.

Emulsions E through H used in Sample i through l were prepared in the way described below.

22 g of gelatin, 20 g of potassium bromide and 10 g of potassium iodide were added to 900 ml of water, and the mixture was stirred and dissolved at 70° C. To the mixture 500 ml of an aqueous solution having dissolved therein 75 g of silver nitrate and 250 ml of an aqueous solution having dissolved therein 40 g of potassium bromide were added over 8 minutes. Moreover, 750 ml of an aqueous solution having dissolved therein 75 g of silver nitrate and 500 ml of an aqueous solution having dissolved therein 60 g of potassium bromide were added to the mixture over 20 minutes. This emulsion was washed with water to remove excess salt. Then, chloroauric acid, sodium thiosulfonate and potassium thiocyanate were added to the emulsion, and thereby the emulsion was chemically sensitized and followed by adding gelatin thereto to obtain Emulsion E.

22 g of gelatin, 26 g of potassium bromide and 10 g of potassium iodide were added to 900 ml of water, and the mixture was stirred and dissolved at 70° C. To the mixture 500 ml of an aqueous solution having dissolved therein 75 g of silver nitrate and 250 ml of an aqueous solution having dissolved therein 20 g of potassium bromide were added over 21 minutes. Moreover, 750 ml of an aqueous solution having dissolved therein 75 g of silver nitrate and 500 ml of an aqueous solution having dissolved therein 74 g of potassium bromide were added to the mixture over 7 minutes. This emulsion was washed with water to remove excess salt. Then, chloroauric acid, sodium thiosulfonate and potassium thiocyanate were added to the emulsion, and thereby the emulsion was chemically sensitized and followed by adding gelatin thereto to obtain Emulsion F.

20 g of gelatin, 36.5 g of potassium bromide and 13.5 g of potassium iodide were added to 800 ml of water, and the mixture was stirred and dissolved at 70° C. After ammonia was added to the mixture, 750 ml of an aqueous solution having dissolved therein 50 g of silver nitrate was immediately added thereto over 5 minutes. Moreover, 750 ml of an aqueous solution having dissolved therein 100 g of silver nitrate and 500 ml of an aqueous solution having dissolved therein 87.5 g of potassium bromide were added to the mixture over 24 minutes. This emulsion was washed with water to remove excess salt. Then, chloroauric acid, sodium thiosulfonate and potassium thiocyanate were added to the emulsion, and thereby the emulsion was chemically sensitized and followed by adding gelatin thereto to obtain Emulsion G.

20 g of gelatin, 26.5 g of potassium bromide and 13.5 of potassium iodide were added to 800 ml of water, and the mixture was stirred and dissolved at 75° C. After ammonia was added to the mixture, 750 ml of an aqueous solution having dissolved therein 50 g of silver nitrate was immediately added thereto over 10 minutes. Moreover, 750 ml of an aqueous solution having dissolved therein 100 g of silver nitrate and 500 ml of an aqueous solution having dissolved therein 92.5 g of potassium bromide were added to the mixture over 24 minutes. This emulsion was washed with water to remove excess salt. Then, chloroauric acid, sodium thiosulfonate and potassium thiocyanate were added to the emulsion, and thereby the emulsion was chemically sensitized and followed by adding gelatin thereto to obtain Emulsion H.

Correlative coefficients between the silver amount of grain and the iodide content of Emulsions E, F, G and H were 0.31, 0.72, 0.49 and 0.81, respectively.

Samples i, j, k and l were exposed through an optical wedge by white light and processed in the same manner as in Example 1. The results are shown in Table 3. All data in Table 3 were obtained by measuring a yellow density.

TABLE 3

| Sample | Relative Sensitivity | RMS (fog + 0.2) | RMS (fog + 1.0) | Gamma Ratio |
|---|---|---|---|---|
| i (Present Invention) | 100 | 0.025 | 0.022 | 0.91 |
| j (Comparative Example) | 100 | 0.025 | 0.019 | 0.98 |
| k (Present Invention) | 102 | 0.022 | 0.018 | 0.94 |
| l (Present Invention) | 102 | 0.022 | 0.016 | 0.99 |

The gamma ratio is defined by $\overline{QR}/\overline{PQ}$ wherein on the characteristic curve, P is a yellow density of 0.2 above fog, Q is a yellow density obtained by an exposure amount providing a log E value 1.0 greater than the log E value necessary to obtain the density P, and R is a yellow density obtained by an exposure amount providing a log E value 1.0 greater than the log E value necessary to obtain the density Q.

Samples i, k and l of the present invention are superior to Sample j of a comparative sample in points of granularity and linearity of gradient. Particularly Sample l is superior in points of all the above characteristic values because both the first blue-sensitive layer and the second blue-sensitive layer contain the emulsion of the present invention.

The structures of compounds used in the examples are shown below.

Sensitizing Dye I

Coupler C-2

-continued
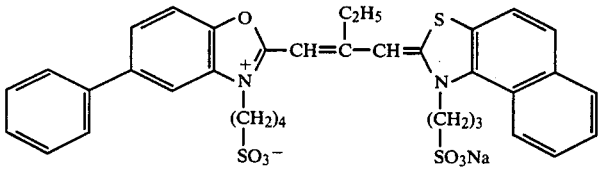
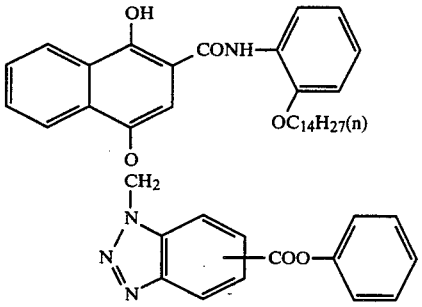
Coupler C-3
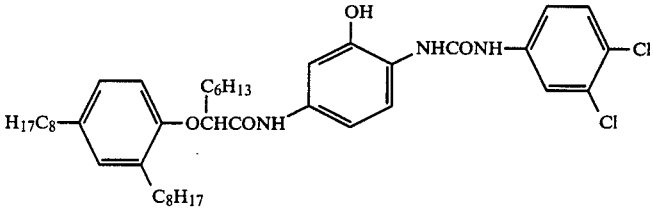
Coupler C-4
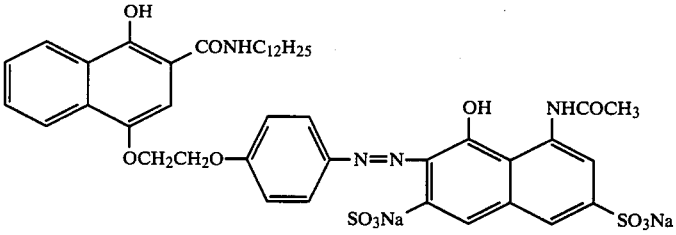
Sensitizing Dye II
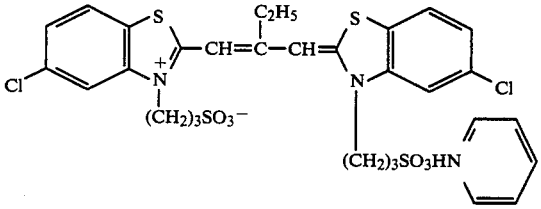
Sensitizing Dye III
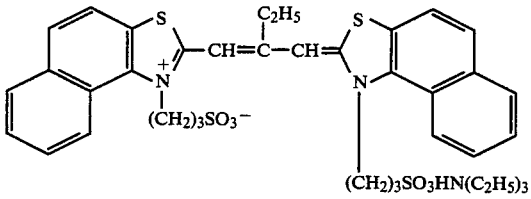
Sensitizing Dye IV
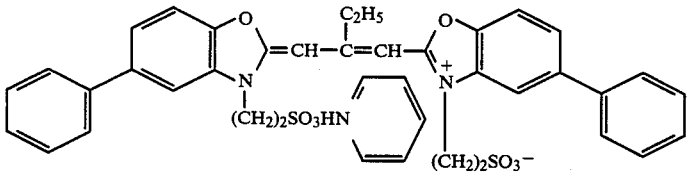
Sensitizing Dye V
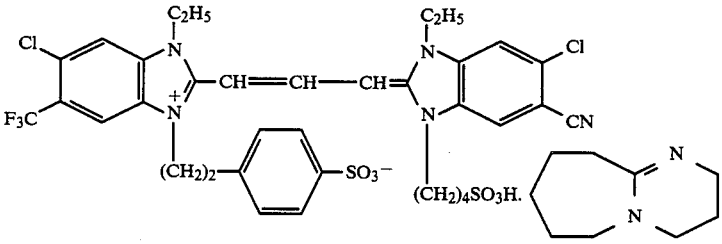
Sensitizing Dye VI
Coupler C-1

-continued
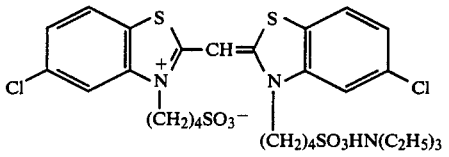
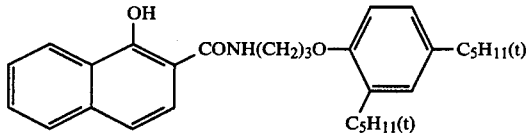
Coupler C-5
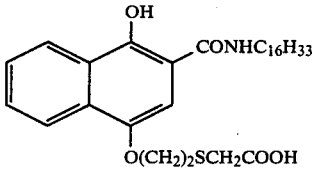
Coupler M-1
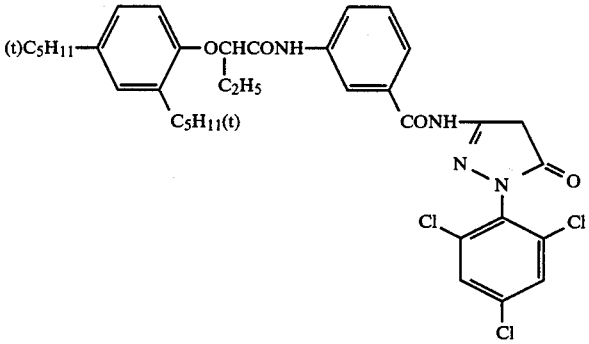
Coupler M-2
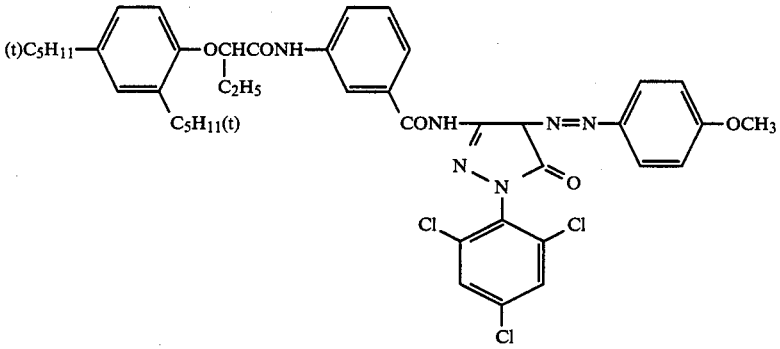
Coupler M-3
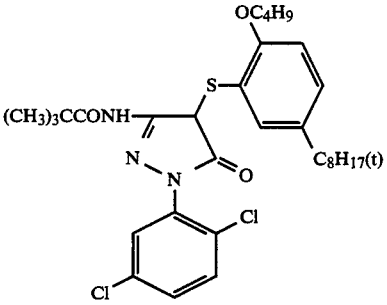
Coupler Y-1
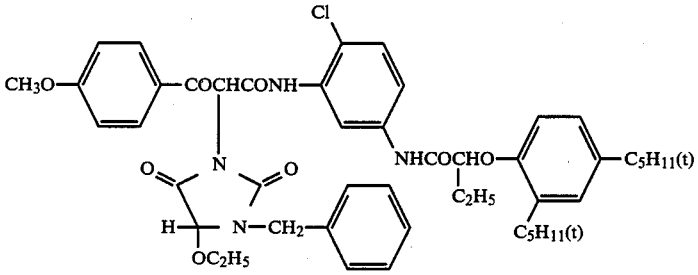
Coupler Y-2
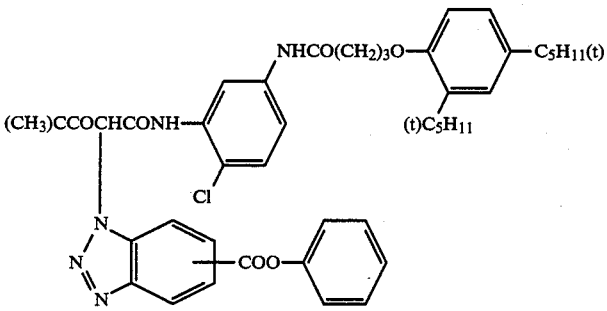
Coupler Y-3

-continued

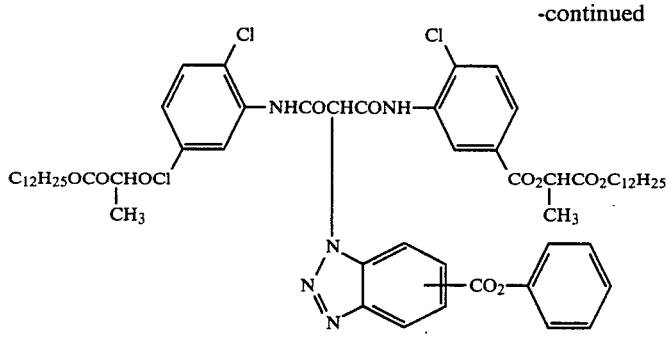

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having coated thereon at least one silver halide emulsion layer containing a group of silver halide grains having a relation that the larger an amount of silver of a grain is, the larger an amount of a content of silver iodide therein is, at a correlative coefficient of not less than 0.7 between a silver halide crystal grain size and a silver iodide content therein.

2. A silver halide color photographic material of claim 1, wherein the correlative coefficient is above 0.8.

3. A silver halide color photographic material of claim 1, wherein said silver halide grains are present in at least a high sensitive emulsion layer and/or a low sensitive emulsion layer having the same color sensitivity.

4. A silver halide color photographic material of claim 1, wherein the group of silver halide grains has the ratio of standard deviation to mean grain size ranging from 0.1 to 0.5.

5. A silver halide color photographic material of claim 4, wherein the ratio is from 0.1 to 0.4.

6. A silver halide color photographic material of claim 1, wherein a protective layer, an interlayer, or a silver halide emulsion layer further contains fine grains of silver halide which are substantially insensitive to light commonly used for photographing.

7. A silver halide color photographic material of claim 1, wherein the silver halide grains are formed by reacting a soluble silver salt and a soluble halide at two or more steps.

8. A silver halide color photographic material of claim 1, wherein a thioether compound is present during the formation of the silver halide grains.

9. A silver halide color photographic material of claim 1, wherein a cadmium salt, a zinc salt, a lead salt, a thallium salt, an iridium salt or a complex salt thereof, a rhodium salt or a complex salt thereof, an iron salt or a complex salt thereof is present during the formation of the silver halide grains or physical ripening of the silver halide emulsion.

* * * * *